US006761091B2

(12) United States Patent
Hsien

(10) Patent No.: US 6,761,091 B2
(45) **Date of Patent: *Jul. 13, 2004**

(54) COMPACT STRUCTURE FOR CONTROLLING MOVEMENT OF PAWL FOR RATCHET TOOLS

(76) Inventor: Chih-Ching Hsien, No. 367, Pei Yang Rd., Feng Yuan,Taichung (TW)

( * ) Notice: Subject to any disclaimer, the term of this patent is extended or adjusted under 35 U.S.C. 154(b) by 52 days.

This patent is subject to a terminal disclaimer.

(21) Appl. No.: 10/195,533

(22) Filed: Jul. 16, 2002

(65) Prior Publication Data

US 2004/0011163 A1 Jan. 22, 2004

(51) Int. Cl.[7] ..... B25B 13/46
(52) U.S. Cl. ..... 81/63.2; 192/43.2
(58) Field of Search ..... 81/60, 62, 63.2; 192/43.2

(56) References Cited

U.S. PATENT DOCUMENTS

| | | | | | |
|---|---|---|---|---|---|
| 3,269,496 | A | * | 8/1966 | Kilness | 192/43.2 |
| 5,231,903 | A | * | 8/1993 | Bockman, Jr. | 81/63.2 |
| 5,957,009 | A | * | 9/1999 | McCann | 81/63.2 |
| 6,516,692 | B1 | * | 2/2003 | Hsien | 81/63.2 |
| 6,609,444 | B1 | * | 8/2003 | Hsien | 81/63.2 |

* cited by examiner

*Primary Examiner*—James G. Smith
(74) *Attorney, Agent, or Firm*—Rosenberg, Klein & Lee

(57) ABSTRACT

A compact structure for controlling movement of the pawl of a ratchet tool includes a selection member movably connected to the tool and a through hole is defined through the selection member. A spring and a bead are received in the through hole and the bead is engaged with one of two positioning recesses in the slot, and the spring is engaged with a notch defined in the pawl. The pawl is shifted to allow one of two ends thereof contact against an inside of the recess of the tool by moving the selection member.

1 Claim, 5 Drawing Sheets

COMPACT STRUCTURE FOR CONTROLLING MOVEMENT OF PAWL FOR RATCHET TOOLS

FIELD OF THE INVENTION

The present invention relates to a ratchet tool that has a spring with one end thereof engaged with the pawl and the other end extends through the selection member and biasing a bead which is engaged with one of two positioning recesses in the slot in which the selection member is received.

BACKGROUND OF THE INVENTION

A conventional pawl control device for shifting the pawl to engage with the teeth of the engaging member in the ratchet tool is located in the tool and cannot be accessed. When the pawl is shifted to one direction, the ratchet tool may output a torque in one direction, vice versa. Generally, the pawl has a protrusion at a rear end thereof and the selection member has a shifting portion which pushes the protrusion and shifts the pawl. The user has to exert a large force to shift the pawl.

The present invention intends to provide a ratchet tool that includes a compact structure of ratchet mechanism and requires only few parts.

SUMMARY OF THE INVENTION

In accordance with one aspect of the present invention, there is provided a compact structure for controlling movement of a pawl for a ratchet tool. The structure includes a head with a hole defined therethrough so as to receive an engaging member therein, and a recess is defined in an inner periphery of the hole so as to receive a pawl therein. A slot is defined in a side of the head and communicates with the recess. Two positioning recesses are defined in an inner periphery of the slot.

A selection member is movably inserted in the slot and has a through hole for receiving a bead and a spring which biases the bead with one of the two positioning recesses and the other end of the spring is engaged with the notch defined in the pawl.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
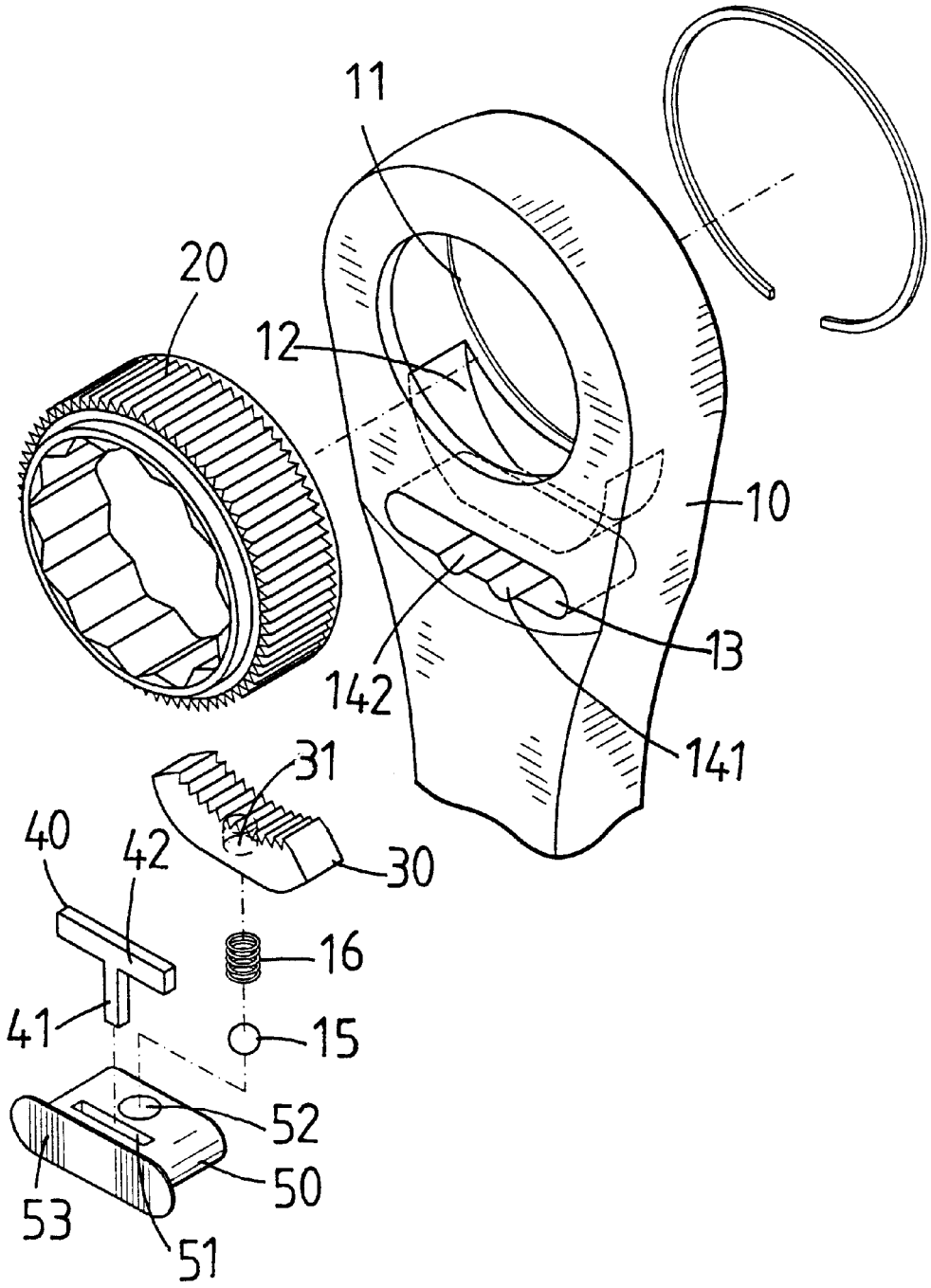
FIG. 1 is an exploded view to show the ratchet tool of the present invention.

Referring to FIGS. 1, 2, 4 and 5, the ratchet tool of the present invention comprises a head 10 having a hole 11 defined therethrough and a shank extends from the head 10. An engaging member 20 with a toothed outer periphery is rotatably received in the hole 11. A recess 12 is defined in an inner periphery of the hole 11 and a pawl 30 is movably received therein. The pawl 30 has a toothed surface in a first side thereof for being matched with the toothed outer periphery of the engaging member 20. A slot 13 is defined in a side of the head 10 and communicates with the recess 12. Two positioning recesses 141, 142 are defined in an inner periphery of the slot 13. A notch 31 is defined in a second side of the pawl 30 and in communication with the slot 13.

A selection member 50 includes a body for being inserted in the slot 13 and a top plate connected to an end of the body. The top plate is located on the side of the tool and includes two knurled portions 51, 53 such that the user may push the top plate at the knurled portions 51, 53 to push the selection member 50 within the slot 13. A through hole 52 is defined through the body of the selection member 50. A bead 15 and a spring 16 are received in the through hole 52, wherein the bead 15 is biased by a first end of the spring 16 and is engaged with one of the two positioning recesses 52 to position the selection member 50 at one of two operation positions. A second end of the spring 16 is engaged with the notch 31 of the pawl 30.

An elongated groove 51 is defined in the body of the selection member 50 and a retaining piece 40 has its insertion 41 inserted in the elongated groove 51. The retaining piece 40 has a bar 42 which contacts and retains the second end of the spring 16 from being disengaged from the through hole 52.

Figure 2:
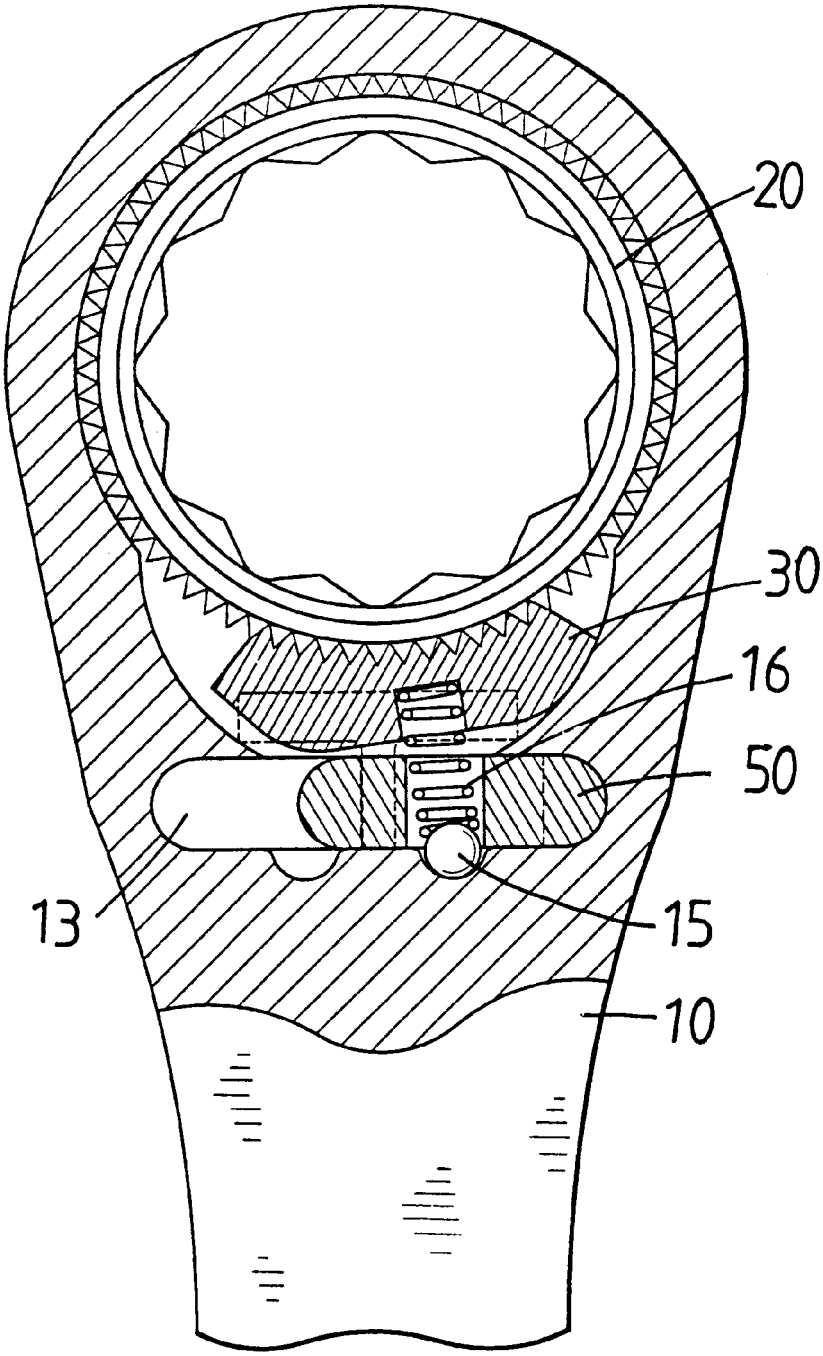
FIG. 2 is a cross sectional view to show the ratchet tool of the present invention, wherein the selection member is moved to the right.

When pushing the selection member 50 to the right as shown in FIG. 2, the bead 15 is shifted and engaged with the positioning recess 141 at the right and the spring 16 exerts a force to shift the pawl 30 to let the right end of the pawl to contact against the inside of the recess 12. Therefore, the ratchet tool may tight or loosen an object when rotating counter clockwise.

Figure 3:
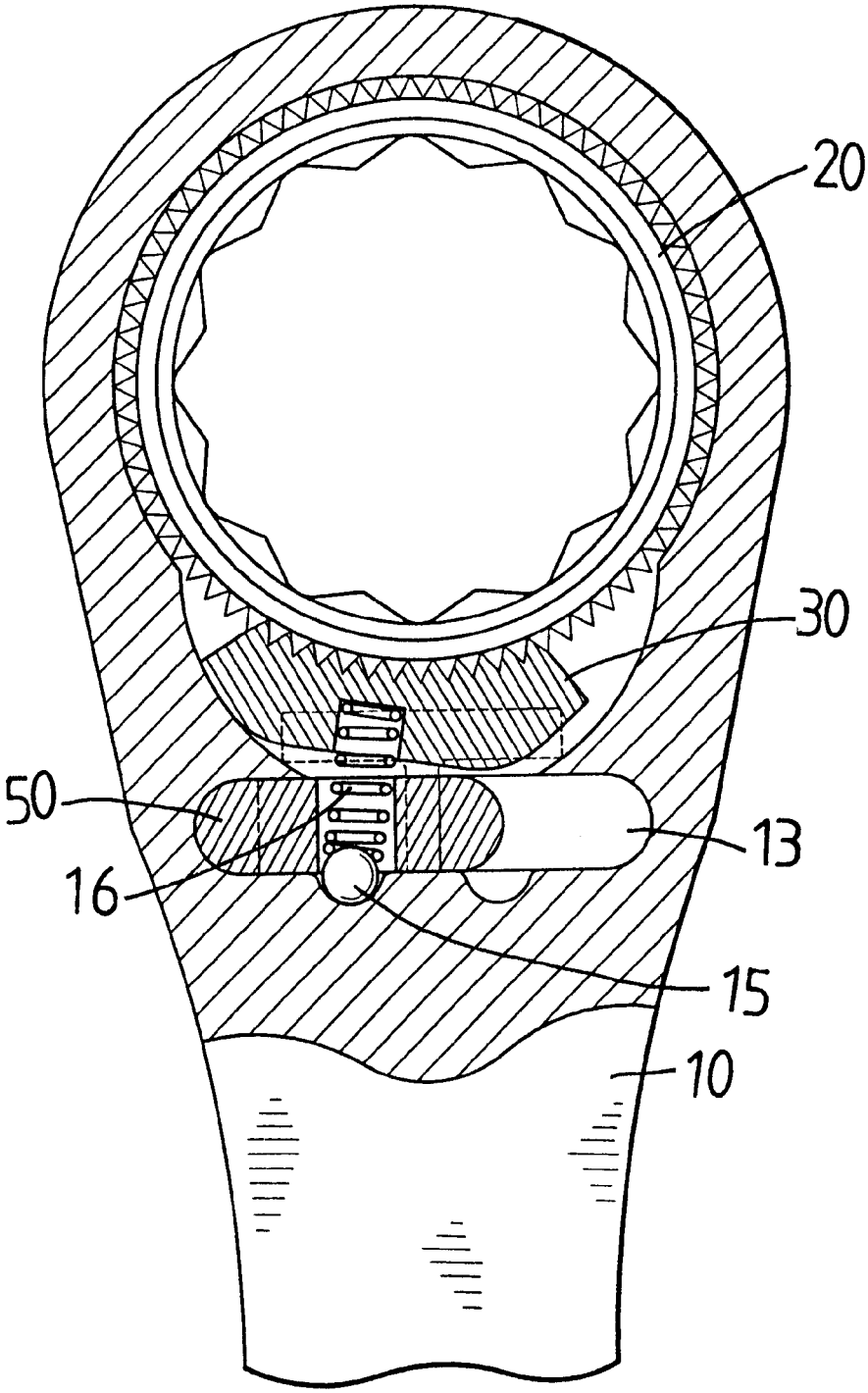
FIG. 3 is a cross sectional view to show the ratchet tool of the present invention, wherein the selection member is moved to the left.
Figure 4:
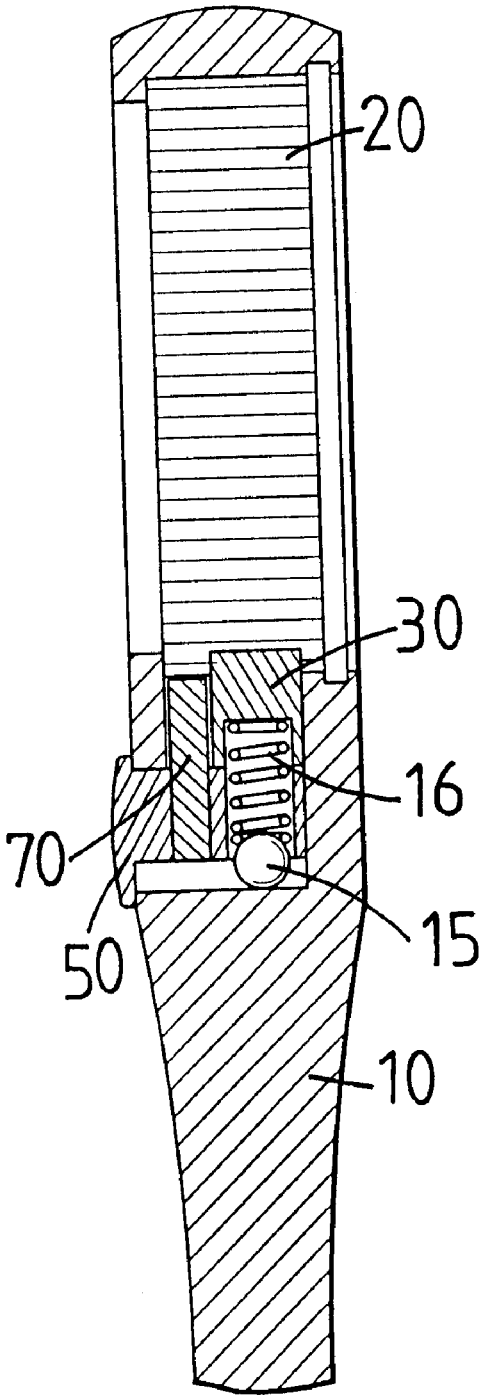
FIG. 4 is a side cross sectional view to show the ratchet tool of the present invention.
Figure 5:
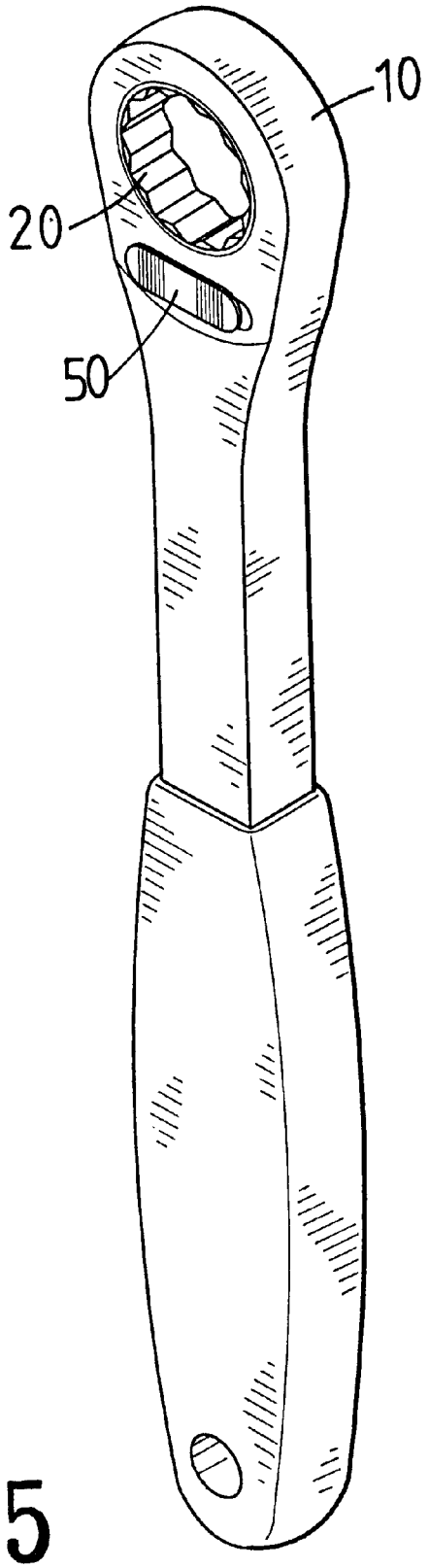
FIG. 5 is a perspective view to show the ratchet tool of the present invention.

Referring to FIG. 3, the selection member 50 can also be pushed to the left and the pawl 30 is then shifted to the left so that the ratchet tool may tight or loosen an object when rotating clockwise.

While we have shown and described the embodiment in accordance with the present invention, it should be clear to those skilled in the art that further embodiments may be made without departing from the scope of the present invention.

What is claimed is:

1. A ratchet tool comprising:

a head having a hole defined therethrough and a recess defined in an inner periphery of the hole, a slot defined in a side of the head and communicating with the recess, two positioning recesses defined in an inner periphery of the slot;

an engaging member rotatably received in the hole of the head and having a toothed outer periphery;

a pawl movably received in the recess and having a toothed surface defined in a first side of the pawl, the toothed surface matched with the toothed outer periphery of the engaging member, a notch defined in a second side of the pawl, and a selection member movably inserted in the slot and a through hole defined through the selection member, a spring and a bead biased by a first end of the spring both received in the through hole, the bead engaged with one of the two positioning recesses in the slot and a second end of the spring engaged with the notch of the pawl the selection member having an elongated groove and a retaining piece inserted in the elongated groove, the retaining piece having a bar which contacts and retains the spring from being disengaged from the through hole, a top plate connected to the selection member and two knurl portions defined in a surface of the top plate.

* * * * *